US006652137B1

(12) United States Patent
Bosch et al.

(10) Patent No.: US 6,652,137 B1
(45) Date of Patent: Nov. 25, 2003

(54) STIRRER FOR A PLANETARY MIXER AND A PLANETARY MIXER INCORPORATING THE STIRRER

(75) Inventors: Edward T. Bosch, Hicksville, NY (US); Kenneth D. Langhorn, Holtsville, NY (US)

(73) Assignee: Charles Ross & Son Company, Hauppauge, NY (US)

( * ) Notice: Subject to any disclaimer, the term of this patent is extended or adjusted under 35 U.S.C. 154(b) by 0 days.

(21) Appl. No.: 09/526,586

(22) Filed: Mar. 16, 2000

(51) Int. Cl.[7] ..... B01F 7/30
(52) U.S. Cl. ..... 366/288; 366/97
(58) Field of Search ..... 366/248, 287, 366/288, 297, 301, 343, 320, 325.4, 300, 200

(56) References Cited

U.S. PATENT DOCUMENTS

| | | | | |
|---|---|---|---|---|
| 373,113 | A | * | 11/1887 | Wagner |
| 374,706 | A | * | 12/1887 | Rosenkranz |
| 375,384 | A | * | 12/1887 | Quack |
| 722,113 | A | * | 3/1903 | Koeiner |
| 1,039,192 | A | * | 9/1912 | Prindle |
| 2,184,225 | A | * | 12/1939 | McDuffee et al. |
| 2,976,131 | A | * | 3/1961 | Miline |
| 3,126,196 | A | * | 3/1964 | Staeger |
| 3,315,947 | A | * | 4/1967 | Nauta |
| 3,348,816 | A | * | 10/1967 | Cox |
| 3,995,840 | A | | 12/1976 | Smader |
| 4,032,117 | A | * | 6/1977 | Burgess |
| 4,311,397 | A | | 1/1982 | Wright |
| 4,337,000 | A | | 6/1982 | Lehmann |
| 4,697,929 | A | | 10/1987 | Muller |
| 5,150,968 | A | | 9/1992 | Inoue |
| 5,345,781 | A | * | 9/1994 | Fels et al. ..... 62/343 |
| 5,482,366 | A | | 1/1996 | König et al. |
| 5,632,596 | A | | 5/1997 | Ross |
| 5,758,963 | A | | 6/1998 | Xie et al. |
| 5,906,432 | A | | 5/1999 | Wade et al. |

FOREIGN PATENT DOCUMENTS

| | | | |
|---|---|---|---|
| CH | 24651 | * | 6/1901 |
| DE | 135685 | * | 2/1901 |

* cited by examiner

*Primary Examiner*—Charles E. Cooley
*Assistant Examiner*—David Sorkin
(74) *Attorney, Agent, or Firm*—Galgano & Burke

(57) ABSTRACT

A stirrer for a planetary mixer has an upper central hub with two outwardly extending horizontal arms and two helical stirring elements, one depending from each arm. According to the presently preferred embodiments, the cross sectional area of the stirring elements is large enough that no bottom crossbar is necessary. The pitch angle of each stirring element is preferably constant from top to bottom. The leading side of the stirring elements has a flat surface whereas the trailing side is curved. The flat surface increases in size moving toward the bottom of the stirring element.

13 Claims, 5 Drawing Sheets

STIRRER FOR A PLANETARY MIXER AND A PLANETARY MIXER INCORPORATING THE STIRRER

BACKGROUND OF THE INVENTION

1. Field of the Invention

The invention relates to mixers used to mix liquids and solids. More particularly, the invention relates to a stirrer for use with a planetary mixer and a planetary mixer incorporating the stirrer.

2. State of the Art

Planetary mixers can be described as mixers that have at least one stirrer (or mixing blade) that revolves (or orbits) in a mixing vessel (or tank) about a central axis while simultaneously revolving on its own axis. Since planetary mixers move the stirrer or stirrers through all areas of the mixing vessel, they are especially useful when mixing high viscosity mixtures which cannot be adequately mixed with a mixer having a fixed stirrer. Planetary mixers are usually oriented vertically with one, two, or three stirrers revolving about a vertical axis. The stirrers are mounted on a drive mechanism which includes means for lifting the stirrers out of the mixing vessel.

The most commonly known planetary mixer is the type that is typically found in kitchens for mixing dough and various food products, having a single stirrer and somewhat hemispherical bottom mixing bowl. Small machines of this type, such as those made by KitchenAid™, are usually found in residential kitchens as well as some commercial kitchens. Larger machines such as those made by Hobart™ are usually found in commercial kitchens. There are other manufacturers of these machines, but most of the designs are similar. These mixers are commonly made in sizes for processing from 1 gallon through 35 gallons. These mixers are generally not capable of vacuum mixing and they are generally not used in industrial manufacturing or with high viscosity mixtures.

The most common type of industrial planetary mixer has multiple stirrers and a flat bottom mixing vessel. These machines are typically used to process materials such as; adhesives, sealants, coatings, foods, cosmetics, pharmaceuticals, plastics, plastisols, composites, metal powders, magnetic coatings, precious metals, ceramics, ceramic metal products, bulk molding compounds, castable materials, dental composites, etc. They are used in any industry where difficult to mix materials need to be processed. They are used for liquid/liquid mixing, liquid/solid mixing and solid/solid mixing. They are used in laboratories, pilot plants and production plants. They are commonly made in sizes for processing from ¼ pint through 500 gallons. The most typical of these have two stirrers, although there are some designs that have three stirrers. See., e.g., U.S. Pat. No. 4,697,929, the complete disclosure of which is hereby incorporated herein by reference. The most common stirrer design is a substantially rectangular element such as that shown in prior art FIGS. 1–3.

As shown in FIGS. 1–3, the stirrer 10 has an upper central mounting collar 12 having a vertical bore 14 and two horizontal intersecting bores 16, 18 for set screws (not shown) and/or drive pins or keys (not shown) for transmitting torque to the stirrer. A pair of arms 20, 22 extend outwardly and downwardly from the collar 12. Vertical stirring elements 24, 26 depend from the arms 20, 22 and are coupled to each other at their bottoms by a cross bar 28.

As mentioned above, the stirring element 10 is coupled to a drive shaft in a mixing assembly which causes the stirrer 10 to rotate about the axis of bore 14 and also causes the stirrer to orbit about another axis, typically the central axis of the mixing assembly. The top speed of the outer edge of the stirring elements 24, 26 can range from less than 5 feet per minute to over 600 feet per minute. This is the combined speed of the rotation of the stirrer on its own axis and the rotation of the stirrer assembly as it orbits about the central axis of the mixer.

Stirrers of the type shown in prior art FIGS. 1–3 have certain drawbacks. Primarily, they do not have good top to bottom mixing ability. It is therefore necessary to increase the mixing time in order to get a homogeneous mix.

Wetting out powders in liquids as well as adding powders to higher viscosity materials usually requires adding a small amount of powder at a time and waiting until this is mixed in, before adding more. This is because of the poor top to bottom mixing action and because adding too much powder typically brings the level of the powder up higher than the top of the stirrers.

Inserting the rectangular stirrers into high viscosity material as well as lifting them out requires a great deal of force because of the crossbar at the bottom of the stirrers. This requires a heavy duty lifting mechanism to overcome these forces thereby increasing the cost of the machine.

The bottom crossbar typically lifts a large amount of material out of the mixing vessel when the stirrers are raised if the viscosity is high. The material must be scraped off of the stirrers by hand. This is very labor intensive and difficult especially on larger machines.

The rectangular stirrers have stagnant areas on the back (or trailing edges) and the sides of the stirrers that can harbor materials that do not get mixed into the batch. This is because these stirrers have flat areas on the backs of the stirring elements. See, e.g., 24*a*, 26*a* in prior art FIG. 3.

The rectangular stirrers also allow material to form balls or columns that get knocked around rather than being mixed when the viscosity increases. If the mixing is allowed to continue past this point, the material quite often gets pushed up out of the mixing vessel and into the area around the gearbox. When this happens, the mixing operation is usually considered a failure, and the mixer must be stopped and the material dug out from the gearbox area by hand.

The rectangular stirrers also cause torque spikes as the stirrers come near each other, and as the stirrers come near the side walls of the mixing vessel. This is because the entire length of the stirring elements of the stirrers (from top to bottom) come near each other at one time and the entire length of the stirring elements (from top to bottom) come near the side of the mixing vessel at one time. These torque spikes are one factor that can limit the ability of the mixer to mix high viscosity materials. Overcoming this problem requires a heavier duty drive system, which increases the cost of the machine.

The crossbar (28 in FIG. 1) at the bottom of a rectangular stirrer is needed primarily for strengthening the stirrer rather than for any mixing action. The crossbars cause undue strain on the mixing machine because of the high side loads that they produce at the farthest point away from the gearbox as well as the additional torque required to rotate the bottom crossbars in high viscosity materials. Their presence is another factor that limits the ability of the mixer to mix high viscosity materials. Overcoming this problem requires a heavier duty drive system, which increases the cost of the machine.

In addition, the arms 20, 22 are normally located below the top of the mixing vessel and are either slightly above or even at the level of the full mixing capacity of the machine. The presence of these arms at this height is a contributing factor to material climbing up out of the mixing vessel. It also limits the amount of powder that can be added at one time and be quickly mixed into the batch.

In order to mix high viscosity materials with a double planetary mixer with rectangular stirrers, it is a common practice to greatly reduce the batch size being mixed, which dramatically reduces the production capacity of the machine. It is a common practice when mixing difficult materials to mix only ½ or even ⅓ of the full working capacity of the mixer. Even by reducing the batch size, problems are still frequently encountered with the material forming balls or columns and not mixing properly.

There are many design alternatives to the rectangular stirrer, each of which overcomes some of the problems discussed above. However, no stirrer design overcomes all of the problems discussed above.

SUMMARY OF THE INVENTION

It is therefore an object of the invention to provide a non-rectangular stirrer for use with a planetary mixer.

It is also an object of the invention to provide a planetary mixer incorporating the stirrer(s) of the invention, especially for use with double planetary mixers of the type having flat bottom mixing vessels and planetary dispensing type mixers.

It is another object of the invention to provide a stirrer which has improved top to bottom turnover.

It is still another object of the invention to provide stirrers that will perform well at wetting out powders that are introduced to the top of a liquid even if larger amounts of powder are added at one time than would normally be added with rectangular stirrers.

It is also an object of the invention to provide stirrers that can be inserted into and removed from high viscosity materials with less force than is required on rectangular stirrers.

It is another object of the invention to provide stirrers that will not lift out a large amount of material when the stirrers are raised after mixing high viscosity materials.

It is still another object of the invention to provide stirrers that will greatly reduce the amount of material that is harbored on the back (or trailing edges) of the stirrers.

It is also an object of the invention to provide stirrers that will reduce the tendency of material to form balls or columns rather than being mixed.

It is another object of the invention to provide stirrers that will greatly reduce the tendency of material to climb up out of the mixing vessel thereby causing a failure of the mixing process.

It is still another object of the invention to provide stirrers that will produce lower torque spikes than rectangular stirrers.

It is also an object of the invention to provide stirrers that will not put unnecessary strain on the gearbox or shafts due to bottom cross bars.

It is another object of the invention to provide stirrers that will not tend to push material up out of the mixing vessel as the material comes in contact with low mounted top cross bars.

It is still another object of the invention to provide stirrers that will typically not require a greatly reduced batch size in order to be able to mix high viscosity materials.

It is also an object of the invention to allow materials of a higher viscosity to be mixed on a given mixer than if the same mixer was fitted with rectangular stirrers.

In accord with these objects which will be discussed in detail below, the stirrer of the present invention includes an upper central hub with two outwardly extending horizontal arms and two helical stirring elements, one depending from each arm. According to the presently preferred embodiments, the cross sectional area of the stirring elements is large enough that no bottom crossbar is necessary. The pitch angle of each stirring element is preferably constant from top to bottom. The leading side of the stirring elements has a flat surface whereas the trailing side is curved. The flat surface increases in size moving toward the bottom of the stirring element. Comparison tests performed with the stirrer of the invention and a conventional rectangular stirrer demonstrated that the stirrers of the invention tolerated a viscosity approximately four times the viscosity at which the conventional stirrers could no longer mix. Visual observation made during the testing indicated a much better top to bottom mixing action as well as much better ability to push powder down into the material. It was also observed that the lifting mechanism was better able to insert and remove the new stirrers into and out of the material than with the standard stirrers and there was very little material lifted out of the mixing vessel when the stirrers were raised. Another test using water soluble dye demonstrated that the shape of the back of the new stirrers eliminated the dead areas that exist with rectangular stirrers.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 3:
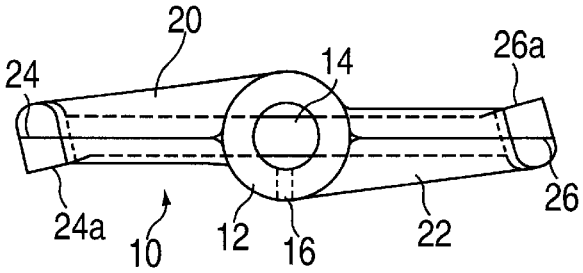
FIG. 3 PRIOR ART
FIG. 3 is a top plan view of the prior art stirrer.
Figure 1:
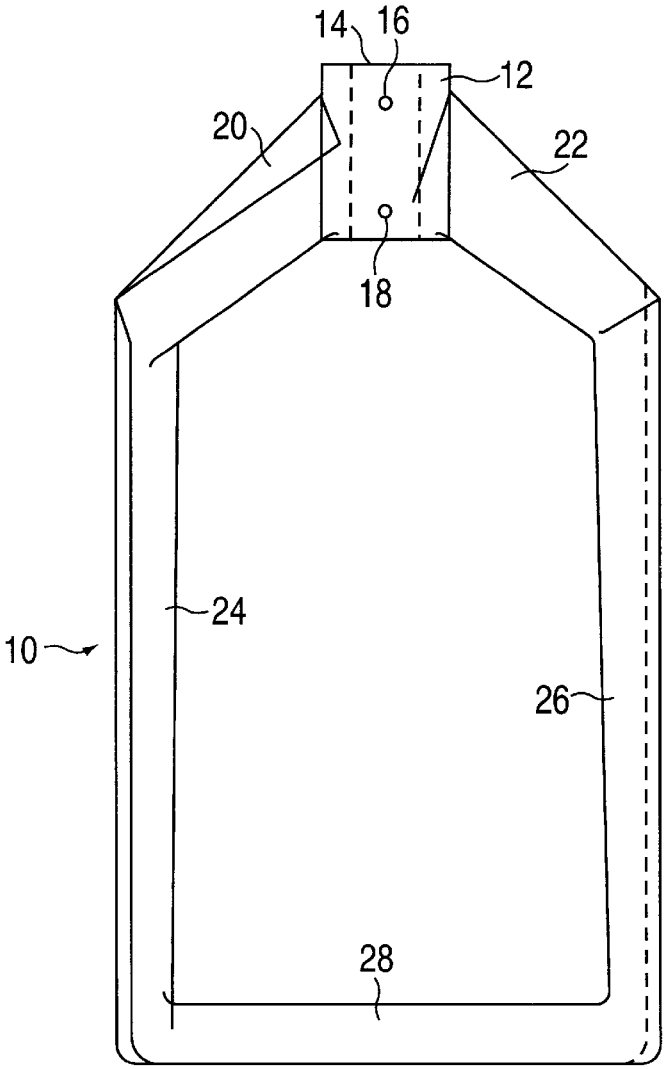
FIG. 1 PRIOR ART
FIG. 1 is a side elevational view of a prior art stirrer.
Figure 2:
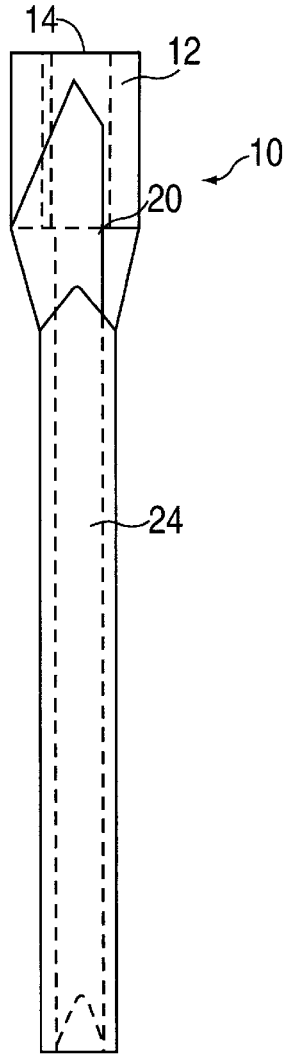
FIG. 2 PRIOR ART
FIG. 2 is a side elevational view rotated 90° from FIG. 1 of the prior art stirrer.
Figures 4, 8:
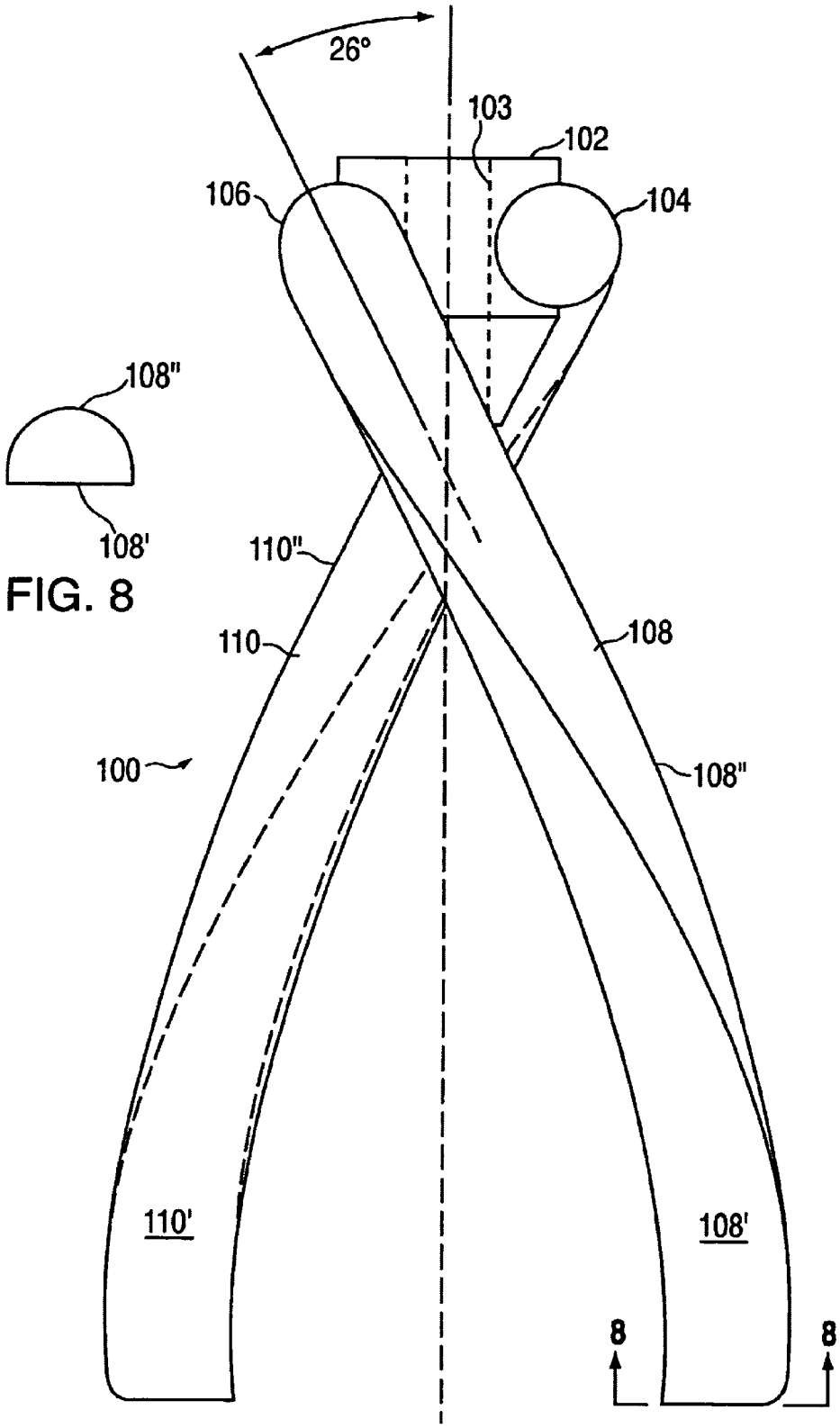
FIG. 4 is a side elevational view of a stirrer according to the invention.
FIG. 8 is a cross-sectional view taken along lines 8—8 of FIG. 4.
Figure 5:
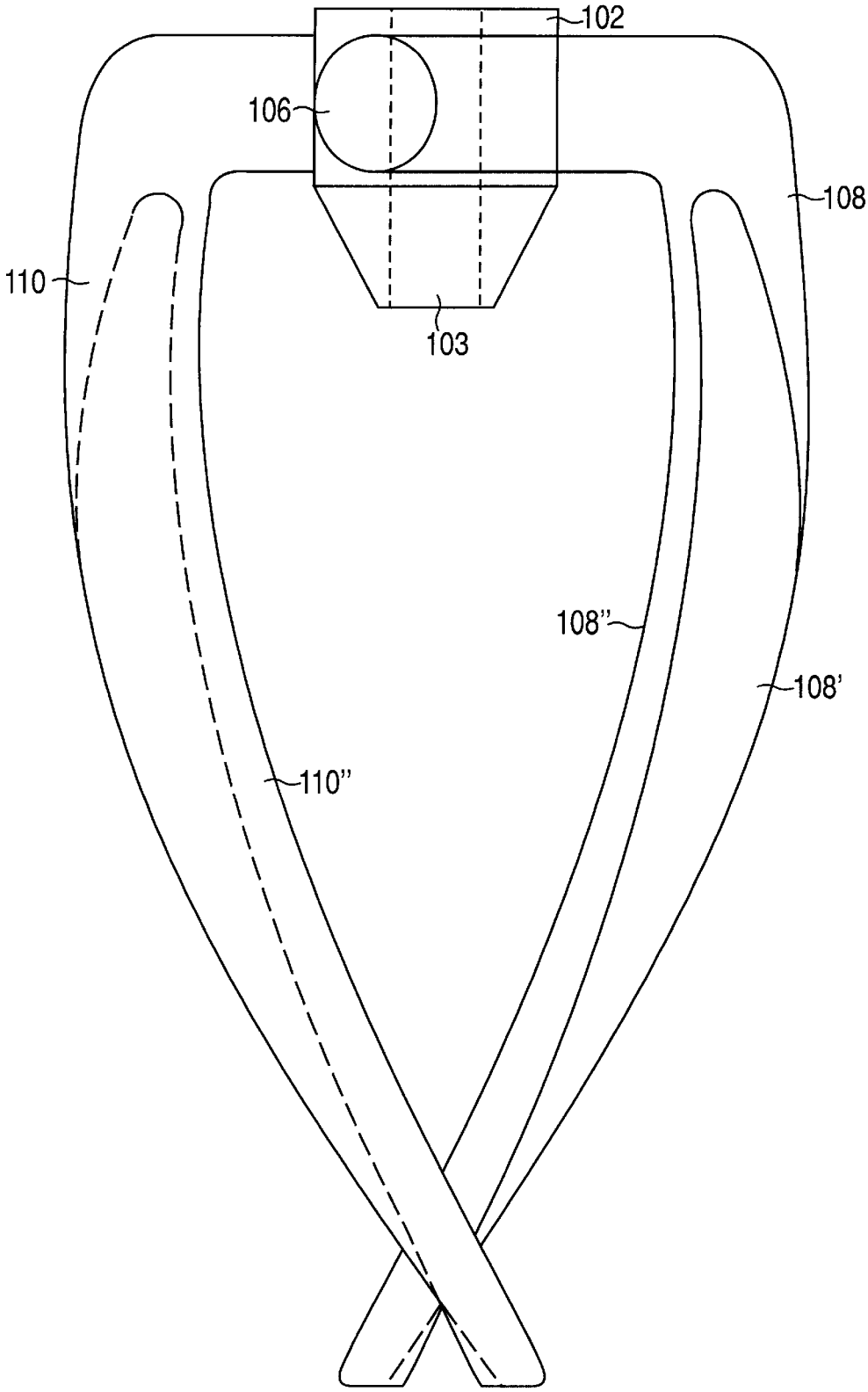
FIG. 5 is a side elevational view rotated 90° from FIG. 4 of the stirrer according to the invention.
Figure 6:
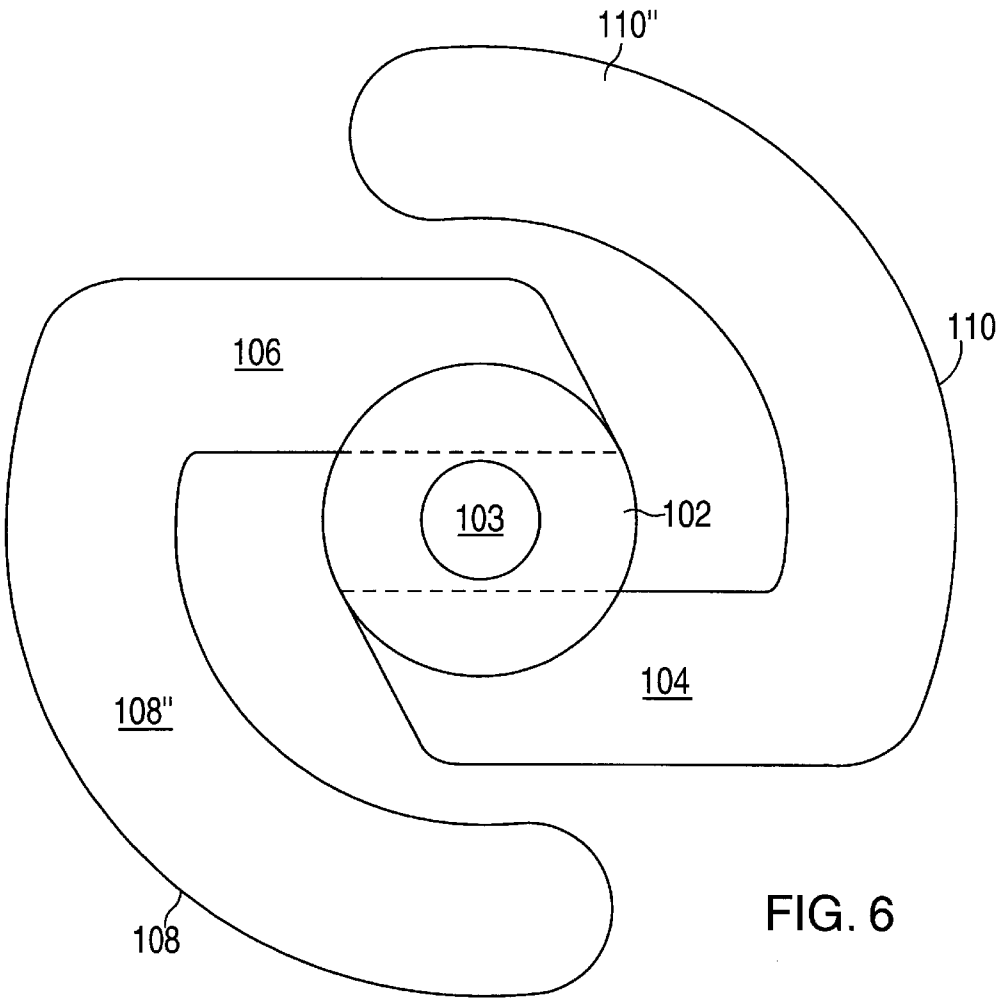
FIG. 6 is a top plan view of the stirrer according to the invention.

Referring now to FIGS. 4 through 6, a stirrer 100 according to the invention has an upper central hub 102 having a mounting bore 103, two outwardly extending horizontal arms 104, 106 and two helical stirring elements 108, 110, one depending from each arm. According to the presently preferred embodiments, the cross sectional area of the stirring elements 108, 110 is large enough that no bottom crossbar is necessary. The pitch angle of each stirring element 108, 110 is preferably constant from top to bottom. As shown in FIG. 4, a presently preferred embodiment has a pitch angle of approximately 26 degrees and as shown in FIG. 6, the stirring elements are twisted helically approximately 90°. As described in more detail below, stirrers with these angles have proven to work well for many applications. It is believed, however, that a smaller angle may be more suitable for low viscosity mixing and a larger angle may wet out powders faster and increase top to bottom mixing.

According to a preferred aspect of the invention, the leading side 108', 110' of the stirring elements 108, 110 has a flat surface whereas the trailing side 108", 110" is curved. The flat surface increases in size moving toward the bottom of the stirring element. Thus the cross sectional area of the stirring elements is greater at the top than at the bottom. As seen best in FIG. 4, the leading sides 108', 110' of the stirring elements present a top to bottom ramp when rotated.

The large enough cross sectional area at the top of the stirrer gives it adequate strength without requiring a bottom crossbar. This allows the stirrer to be inserted into and removed from high viscosity material with much less force, which allows a mixer with a lighter duty lifting mechanism to be used for high viscosity materials. This also puts less strain on the shafts, gearboxes, motor, etc. during the mixing operation than if the stirrers had bottom crossbars. Because less strain is placed on the mixer, higher viscosity material can be mixed. Because there are no bottom crossbars, the stirrers of the present invention lift very little material out of the mixing vessel when they are raised.

The helical twist of the stirring elements 108, 110 helps to improve top to bottom mixing and also helps to push powders down into a batch quickly. This twisted shape also helps to hold material down in the mixing vessel rather than allowing it to form balls or columns and climb up out of the mixing vessel. It also reduces the torque spikes that occur with rectangular stirrers. This is because a pair of stirrers (FIG. 7) approach each other with a scissor type action rather than approaching each other all at once. This is also because the stirrers come in close proximity to the sidewalls of the mixing vessel gradually rather than all at once.

Figure 7:
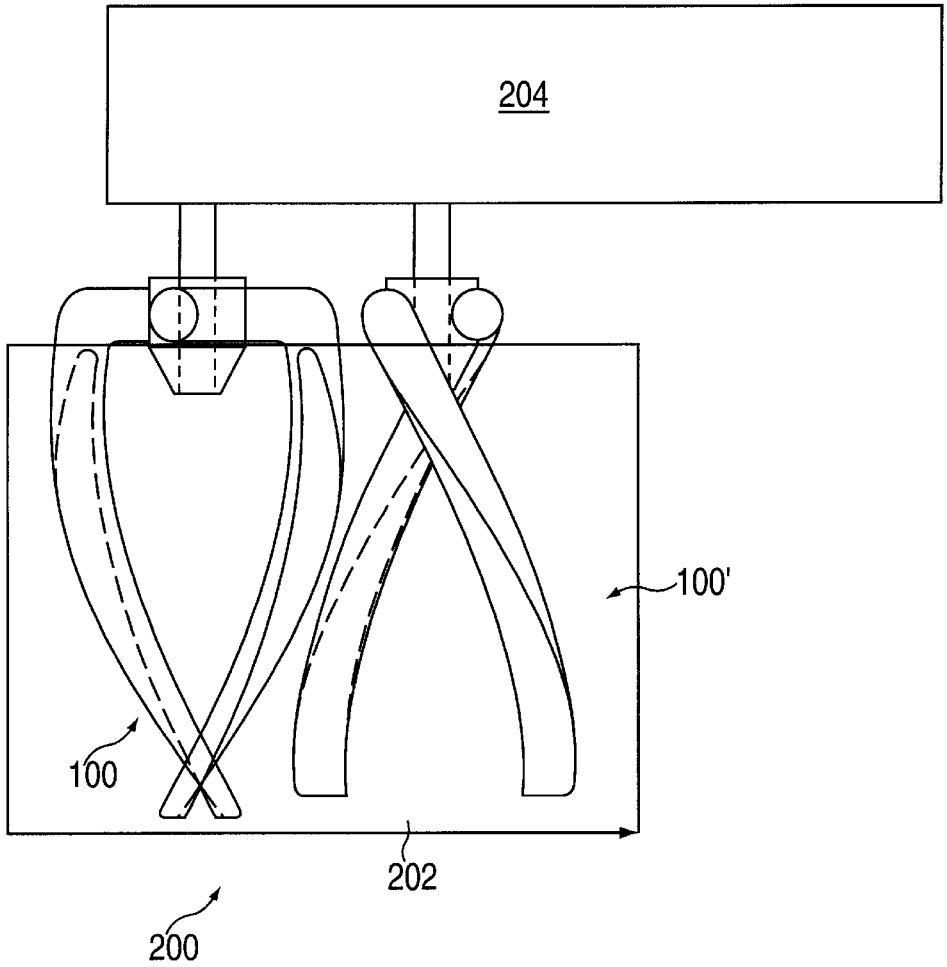
FIG. 7 is a schematic view of a planetary mixer incorporating two stirrers according to the invention.

The top arms 104, 106 are horizontal rather than downward sloping from the hub 102 and they are mounted higher than the top of material being mixed. Ideally they are mounted higher than the top of the mixing vessel (FIG. 7). Because the stirring elements 108, 110 are attached to the arms 104, 106, they also are higher than they are on standard stirrers. This helps to push powders down into the material as powders are added to the batch which reduces the amount of time needed to process a batch. This also allows more powder to be added at one time and this also reduces the amount of time needed to process a batch. Since the arms 104, 106 and the stirring elements 108, 110 are higher than on standard stirrers, any material that may start to get pushed up above the normal mixing level will be pushed back down into the batch in most cases.

The first embodiment of the invention was made by bending round bar-stock to form the top arms 104, 106 and the stirring elements 108, 110 as two unitary pieces. The flat surface 108', 110' that was cut into the stirring elements 108, 110 is located such that it always faces forward in relation to the direction of rotation of the stirrer about its axis. This flat surface helps to push material down toward the bottom of the mixing vessel so that there are less voids than with standard stirrers. This helps to increase the amount of work that is put into the material. Although this flat surface faces forward (forms a right angle with the torque vector) in the first embodiment, it may be useful to angle this flat surface either inward or outward to change the flow characteristics for certain applications.

The semi-circular shape of the back (or trailing side) 108", 110" of the stirring elements 108, 110 helps to ensure that the backs of the stirring elements get wiped clean of any material that frequently would remain on the back of standard stirrers. It should be apparent to those skilled in the art that the shape of the back of the stirrers could be of another shape as long as it is smooth (with no sharp corners) and basically rounded.

As mentioned above, the stirring elements 108, 110 have a full circular cross section at the top and the flat area starts near the top and gradually increases in width toward the bottom where the stirring elements have substantially semi-circular cross sections. This is to increase the strength at the top of the stirring elements where it is needed most.

The length of the stirrers will vary in proportion to the width of the stirrers from one size mixer to another. It is preferred to keep the same pitch angle from one size stirrer to another and to allow the helical twist angle to be larger in larger stirrers and smaller in smaller stirrers. The reason for this is that the pitch angle determines the flow characteristics within the mixer. By keeping the pitch angle the same from one size stirrer to another, better scalability from one size mixer to another may be achieved. If stirrers with different pitch angles are provided for special applications, the new pitch angle of each new version should be the same from one size mixer to another.

After the first embodiment of the present invention was completed, a test was performed to compare the ability of the new stirrers to mix high viscosity materials with that of standard rectangular stirrers. This test was done on a standard duty double planetary mixer with a working capacity of 40 gallons made by Charles Ross & Son Company. FIG. 7 schematically illustrates such a mixer 200 having a mixing vessel 202, a drive assembly (gearbox) 204, and two stirrers 100, 100' according to the invention. The stirrers are mounted close to each other as shown and the pair of rotating stirrers are caused to orbit the axis of the mixing vessel by the drive assembly 204.

The test was performed with one mixer having conventional stirrers attached to it and then with stirrers according to the invention. The material used was a viscous silicone oil (Elastomer 20-N made by Wacker) with a fumed silica powder (HDK Fumed Silica made by Wacker) added incrementally to increase the viscosity.

The process was started by adding 20 gallons of the silicone oil to the mixer, and then small amounts of the silica powder were added on top of the batch and mixed in. The mixing vessel was evacuated after each powder addition to eliminate any air entrainment and therefore achieve the highest viscosity and density possible. Samples were taken periodically for viscosity measurement. All viscosity measurements were made with a Brookfield HBT Viscometer with a Helipath stand. It is important to point out that viscosity measurement is very subjective to the type of viscometer being used, especially at such high viscosities, but since the same viscometer was used for all of the measurements during this test, these numbers are useful for comparative purposes.

The test was started with the standard rectangular stirrers. After 22 lbs. of silica powder had been mixed in, the viscosity was measured at 1,440,000 centipoise and the temperature was measured at 20.1 degrees Celsius. After 31 lbs. of silica powder had been mixed in, the viscosity was measured at 7,360,000 centipoise and the temperature was measured at 26.0 degrees Celsius. After 37 lbs. of silica powder had been mixed in, the viscosity was measured at 11,520,000 Centipoise and the temperature was measured at 26.6 degrees Celsius. After 45 lbs. of silica powder had been mixed in, the viscosity was measured at 34,000,000 Centipoise and the temperature was measured at 31.3 degrees Celsius.

At this point, the material could no longer be effectively mixed with the rectangular stirrers because the material climbed up out of the mixing vessel and was pushed around by the gearbox. It was necessary to scrape all of the material back down into the mixing vessel from the gearbox area as well as from the stirrers themselves several times to complete the mixing, and the stirrers were then changed to the new design.

The test was then resumed with the same material, and then additional powder was added. After a total of 48 lbs. of silica powder had been mixed in, the viscosity was measured at 92,800,000 Centipoise and the temperature was measured at 33.7 degrees Celsius. After a total of 52 lbs. of silica powder had been mixed in, the viscosity was measured at 115,200,000 Centipoise and the temperature was measured at 36.0 degrees Celsius. After a total of 55 lbs. of silica powder had been mixed in, the viscosity was measured at 133,000,000 Centipoise and the temperature was measured at 41.3 degrees Celsius.

After this last powder addition, and after the material appeared to be thoroughly mixed, the belt started slipping on the "Reeves" belt drive on the mixer. The test was stopped at this point. The "Reeves" belt drive is a device that is sometimes used to vary the speed of the mixer and it is located between the motor and the gear reducer of the mixer. It is important to point out that various other types of drive systems are available, some of which are much stronger, for mixers made by Charles Ross & Son Company, but a machine with a heavy duty drive system was not available at the time of this test. It is also important to point out that the belt slipping was a limitation of the mixer that was tested, and not the stirrers. The mixing action was still very good up to the point that the mixing was stopped. The test was stopped at a viscosity that was almost 4 times higher than what would commonly be mixed on this machine.

Upon examination of the finished material, it was found to be extremely tough in nature, such that it was difficult to insert a metal spatula with a thin flat blade 1" in width into the material by hand.

A visual observation was made during the testing that indicated a much better top to bottom mixing action as well as much better ability to push powder down into the material. It was also observed that the lifting mechanism was better able to insert and remove the new stirrers into and out of the material than with the standard stirrers and there was very little material lifted out of the mixing vessel when the stirrers were raised.

A second test was performed to determine whether or not the shape of the back of the new stirrers eliminated the dead areas that exist with rectangular stirrers. This test was done on a double planetary mixer with a working capacity of 1½ gallons made by Charles Ross & Son Company.

First, the standard rectangular stirrers were used. One and a half gallons of white spackling compound were added to the mixing vessel and the backs of the stirrers were coated with a water based red dye. After five minutes of mixing, the stirrers were raised and scraped down. There was still evidence of the red dye on the backs of the stirrers at this point.

The same procedure was then repeated using the stirrers of the invention. All parameters were identical including the speed of the stirrers. After 5 minutes, there was no red dye left on the stirrers of the invention.

This test was then repeated using the stirrers of the invention except that this time the stirrers were raised after 2 minutes, and again there was no red dye left on the stirrers.

There have been described and illustrated herein several embodiments of a stirrer for a planetary mixer and a planetary mixer incorporating the same. While particular embodiments of the invention have been described, it is not intended that the invention be limited thereto, as it is intended that the invention be as broad in scope as the art will allow and that the specification be read likewise.

What is claimed is:

1. A double planetary mixer, comprising:

a) mixing vessel having an axis;

b) at least two stirrers mounted adjacent to one another, each of said stirrers comprising:

i) an upper central hub having an axis of rotation offset from said axis of said mixing vessel;

ii) a first non-material contacting arm coupled to said hub and extending substantially horizontally therefrom;

iii) a second non-material contacting arm coupled to said hub and extending substantially horizontally therefrom;

iv) a first stirring element having first and second ends and extending helically relative to said axis of rotation, said first arm coupling said first end of said first stirring element to said hub; and v) a second stirring element having first and second ends and extending helically relative to said axis of rotation, said second arm coupling said first end of said second stirring element to said hub; and wherein said second ends of said stirring elements are disconnected from one another and wherein each of said first and second stirring elements has a constant pitch angle; and c) drive means disposed above said mixing vessel and coupled to said pair of stirrers for rotating said stirrers about said axis of rotation of said upper central hub thereof and about said axis of said mixing vessel.

2. A double planetary mixer according to claim 1, wherein:

at least one of said first and second stirring elements has a non-circular cross section along at least some of its length.

3. A double planetary mixer according to claim 1, wherein:

at least one of said first and second stirring elements has a cross section which decreases in area along at least some of its length.

4. A double planetary mixer according to claim 1, wherein:

said pitch angle is approximately 26°.

5. A double planetary mixer according to claim 1, wherein:

each of said first and second stirring elements has a substantially similar helical twist angle.

6. A double planetary mixer according to claim 5, wherein:

said twist angle is approximately 90°.

7. A double planetary mixer according to claim 1, wherein:

at least one of said first and second stirring elements has a flat front surface along at least some of its length and a curved back surface along at least some of its length.

8. A double planetary mixer, comprising:

a) mixing vessel having an axis;

b) at least two stirrers mounted adjacent to one another, each of said stirrers comprising:

i) an upper central hub having an axis of rotation offset from said axis of said mixing vessel;

ii) a first non-material contacting arm coupled to said hub and extending substantially horizontally therefrom;

iii) a second non-material contacting arm coupled to said hub and extending substantially horizontally therefrom;

iv) a first stirring element having first and second ends and extending helically relative to said axis of rotation, said first arm coupling said first end of said first stirring element to said hub; and v) a second stirring element having first and second ends and extending helically relative to said axis of rotation, said second arm coupling said first end of said second stirring element to said hub; and wherein said second ends of said stirring elements are disconnected from one another and wherein each of said first and second stirring elements has a flat front surface along most of its length and a curved back surface along at least most of its length; and c) drive means disposed above said mixing vessel and coupled to said pair of stirrers for rotating said stirrers about said axis of rotation of said upper central hub thereof and about said axis of said mixing vessel.

9. A double planetary mixer according to claim 8, wherein:

at least one of said first and second stirring elements has a cross section which decreases in area along at least some of its length.

10. A double planetary mixer according to claim 8, wherein:

each of said first and second stirring elements has a constant pitch angle.

11. A double planetary mixer according to claim 10, wherein:

said pitch angle is approximately 26°.

12. A double planetary mixer according to claim 8, wherein;

each of said first and second stirring elements has a substantially similar helical twist angle.

13. A double planetary mixer according to claim 12, wherein:

said twist angle is approximately 90°.

* * * * *